US006780120B2

(12) United States Patent
Murray

(10) Patent No.: US 6,780,120 B2
(45) Date of Patent: Aug. 24, 2004

(54) ADJUSTABLE LENGTH GOLF PUTTER

(76) Inventor: Donald K. Murray, 915 Middle Dr., Ft. Walton Beach, FL (US) 32547

( * ) Notice: Subject to any disclaimer, the term of this patent is extended or adjusted under 35 U.S.C. 154(b) by 167 days.

(21) Appl. No.: 10/288,348

(22) Filed: Nov. 4, 2002

(65) Prior Publication Data

US 2004/0087385 A1 May 6, 2004

(51) Int. Cl.[7] ..... A63B 53/16

(52) U.S. Cl. ..... 473/239; 473/294; 473/296; 473/299

(58) Field of Search ..... 473/296, 298, 473/299, 239, 294, 297; 403/377, 378, 379, 298

(56) References Cited

U.S. PATENT DOCUMENTS

| | | | | |
|---|---|---|---|---|
| 3,539,185 A | | 11/1970 | Andis | 273/81.2 |
| 5,029,860 A | | 7/1991 | Ehrich | 273/81.2 |
| 5,282,619 A | | 2/1994 | Napolitano et al. | 273/80 D |
| 5,415,399 A | | 5/1995 | Kettelson | 273/81.2 |
| 5,452,891 A | | 9/1995 | Thomas | 273/81.2 |
| D363,519 S | | 10/1995 | Gooden | D21/221 |
| D364,436 S | | 11/1995 | Thomas | D21/221 |
| 5,649,870 A | | 7/1997 | Harrison | 473/239 |
| 5,976,030 A | | 11/1999 | Hsieh | 473/296 |
| 6,213,890 B1 | * | 4/2001 | Prince | 473/292 |
| 6,283,874 B1 | | 9/2001 | Studebaker | 473/227 |

* cited by examiner

*Primary Examiner*—Stephen Blau
(74) *Attorney, Agent, or Firm*—Needle & Rosenberg, PC.

(57) ABSTRACT

A golf club, such as a putter, having a first tube, a second tube, and a clamp assembly. The clamp assembly defines a longitudinally extending bore, a shoulder surface on the exterior surface of the clamp assembly, an orifice extending from the inner surface of the bore toward the exterior surface of the clamp assembly, and an aperture extending between the orifice and the exterior surface of the clamp assembly. A lower portion of the clamp assembly is received within the first tube. The putter further including a shaft and a captured fastening member. The shaft is received within the bore of the clamp assembly and a portion of the shaft proximate its rear end is received within the second tube. The fastening member is operatively received within the orifice of the clamp assembly and is in selective contact with a portion of the exterior surface of the shaft such that the shaft and the second tube may be fixed relative to the clamp assembly.

43 Claims, 4 Drawing Sheets

ADJUSTABLE LENGTH GOLF PUTTER

BACKGROUND

1. Field of Invention

This invention relates generally to golf clubs. More particularly, this invention relates to a golf putter having a collapsible and adjustable length shaft.

2. Description of the Prior Art

Putters available today generally fall into three categories. One is the conventional length putter, which typically has a shaft length of 31 to 35 inches, that the golfer uses in a manner that requires that the hands of the golfer to grip the top of the shaft of the putter and swing the club with extended arms along a line in an effort to cause the ball to go into the hole. Another type of putter available on the market is the long shafted putter, which may have a shaft length of 46 inches or more, that is typically used with the shaft held in a near vertical position by gripping the middle of the shaft with one hand and the top of the shaft with the other hand. In this example, the top of the shaft is usually rested on or near the upper chest of the golfer. Finally, in recent years, an intermediate length putter has become popular in which in which the top of the shaft is rested on or against the mid-section of the golfer. These "belly" length putters are normally gripped with the hands proximate each other at a point intermediate the top and the bottom of the shaft or are gripped with spread hands as described above for the long shafted putter.

Putters are not inexpensive, so for the average golfer who typically is always looking for a "better" putter, it is an cost prohibitive solution to have to buy three different length putters to attempt to find a putter that "works." Particularly since what seems to "work" varies from day to day for the average golfer. Also, since golfers range widely in body shaft and size, the conventional lengths of the production fixed-length shaft putters may be inappropriate for an individual golfer.

Conventional long shafted putters present special problems of their own. Since they are longer than any other golf club used to play the game, they present difficulties in transport to and from the course. Numerous instances of shaft breakage have been reported, which results in both inconvenience and expense, particularly to the average golfer.

SUMMARY

The present invention overcomes the prior art limitations by providing a golf club, such as a golf putter, in which the length of the shaft can be adjustable prior to the beginning of play or prior to transport of the club so that the putter can be sized to approximate a conventional fixed shaft length putter as desired by the individual golfer and so that the length of the shaft of the putter may be customized by the player to match the individual's physiology.

In one exemplary embodiment, an extendable shaft for a golf club, such as a putter, includes a first elongate tube, a second elongate tube, a clamp assembly, an elongate shaft, and a captured fastening member. The bottom end of the first tube may be connected to a club head, such as a putter head. The clamp assembly has an exterior surface and defines a bore extending longitudinally from a proximal end to a distal end. A male protrusion extends from the surface of the bore of the clamp assembly. A lower portion of the clamp assembly, proximate the distal end of the clamp assembly, is sized and shaped for complementary receipt within a top end of the first tube so that the clamp assembly may be fixed relative to the first tube.

The clamp assembly further defines an orifice extending from the surface of the bore toward the exterior surface of the clamp assembly. The orifice defines an annular shoulder surface proximate the exterior surface and an aperture extending between the exterior surface of the clamp assembly and the annular shoulder surface.

The elongate shaft has a forward end and a spaced rear end and is sized and shaped for complementary receipt within the bore of the clamp assembly. The shaft has a longitudinally extending slot defined in a portion thereof that is sized and shaped for complementary engagement with the male protrusion of the clamp assembly. In use, at least a portion of the shaft proximate its rear end is received within a bottom end of the second tube so that the shaft may be fixed relative to the second tube.

A captured fastening member that is sized and shaped for operative receipt in the orifice of the clamp assembly is also included. The captured fastening member is movable between a disengaged position and an engaged position. In the disengaged position, a drive end of the fastening member is moved toward the annular shoulder surface of the orifice so that the contact end is spaced from the exterior surface of the shaft. In the engaged position, the drive end of the fastening member is moved away from the annular shoulder surface of the orifice so that a portion of a contact end of the fastening member is in contact with a portion of the exterior surface of the shaft. Thus, in the engaged position, the shaft and the second tube are fixed relative to the clamp assembly.

BRIEF DESCRIPTION OF THE DRAWINGS

The accompanying drawings, which are incorporated in and constitute part of this specification, illustrate several embodiments of the invention and together with the description, serve to explain the principals of the invention.

DETAILED DESCRIPTION OF THE INVENTION

Figure 1:
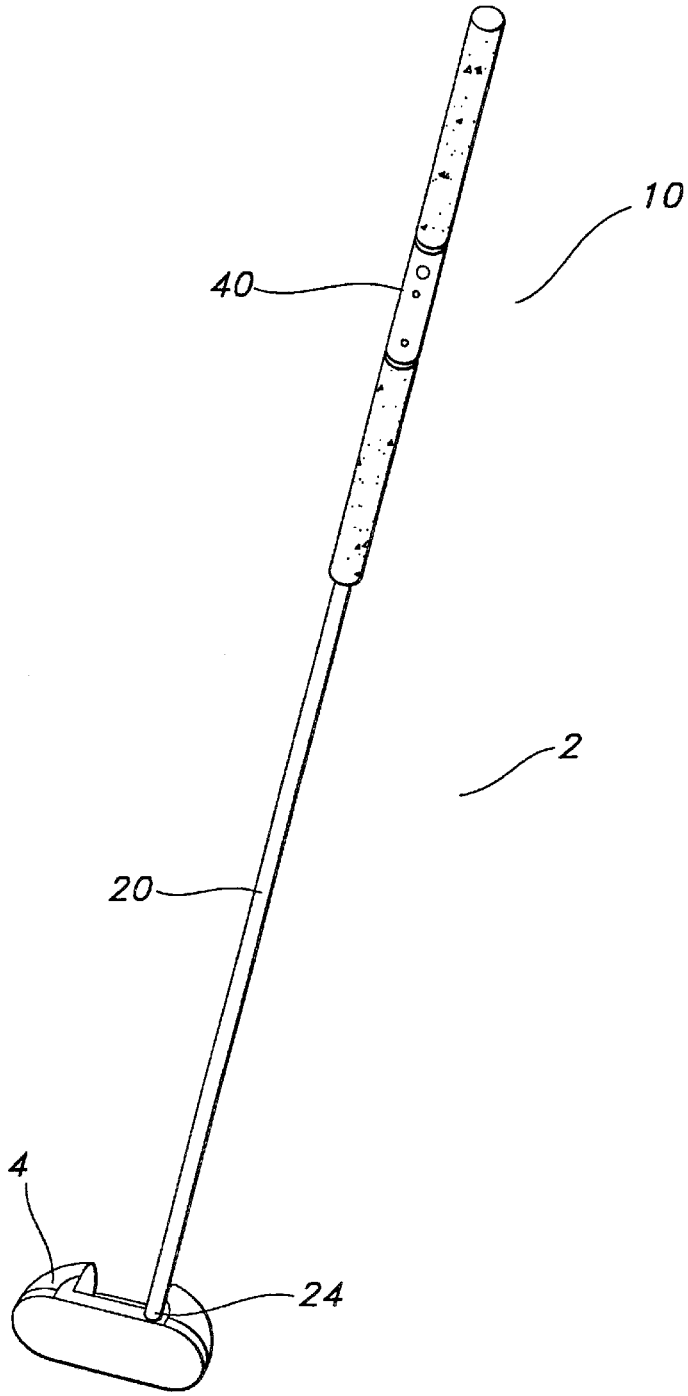
FIG. 1 is a perspective view of an embodiment of the invention showing a putter having an extendable shaft that is not in an extended position.
Figure 2:
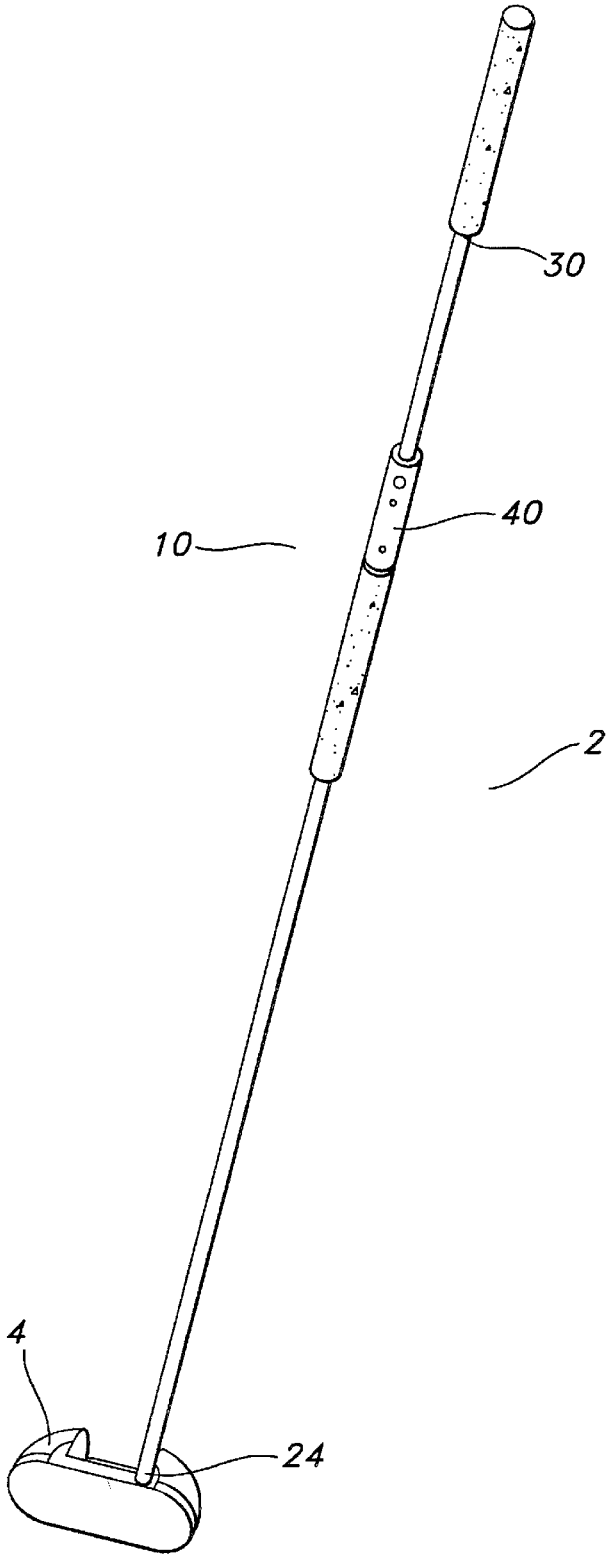
FIG. 2 is a perspective view of an embodiment of the invention showing the putter of FIG. 1, in which the shaft is in an extended position.
Figure 3:
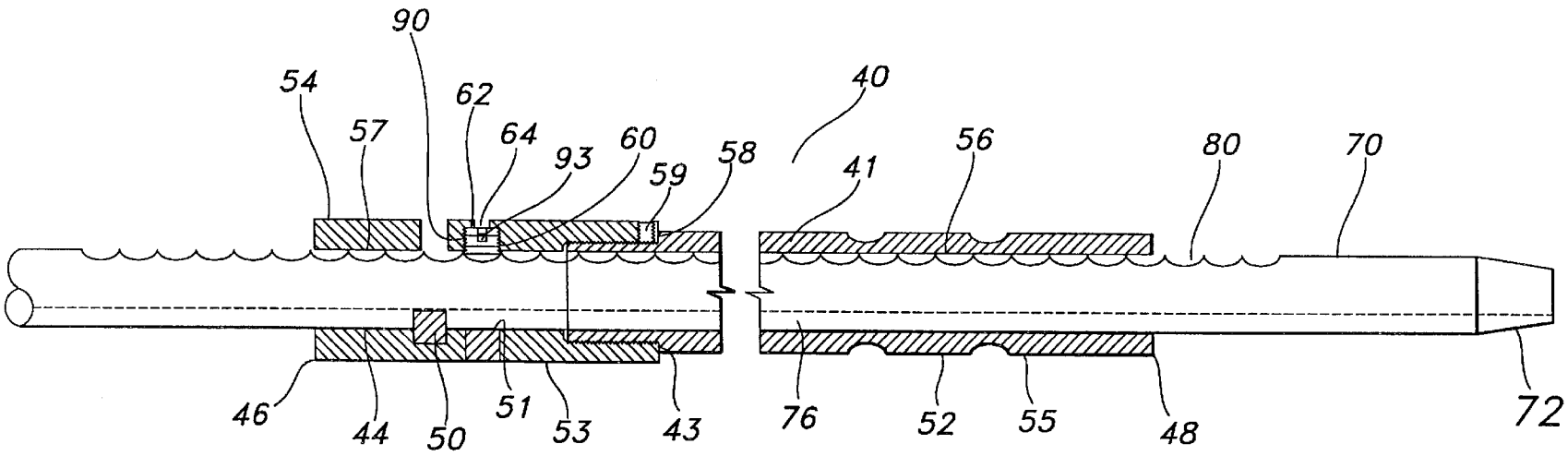
FIG. 3 is a cross-sectional view of an embodiment of a clamp assembly, an elongate shaft operably disposed within a bore of the clamp assembly, and a captured fastening member operably disposed in an orifice of the clamp assembly.

The present invention is more particularly described in the following examples that are intended to be illustrative only since numerous modifications and variations therein will be apparent to those skilled in the art. As used in the specification and in the claims, the singular form "a," "an" and "the" include plural referents unless the context clearly dictates otherwise.

Referring to the figures, an extendable shaft 10 for a golf club 2, such as a putter, is provided. The extendable shaft 10 includes a first elongate tube 20, a second elongate tube 30, a clamp assembly 40, an elongate shaft 70, and a captured fastening member 90. The first elongate tube 20, which may be a conventional golf shaft, has a open top end 22 and a spaced bottom end 24. Similarly, the second elongate tube 30 has an open bottom end 32. The bottom end of the first tube may be connected to a club head 4, such as a putter head 4. In use, the second elongate tube may be moved to and fixed in a selected position by the operator so that the second elongate tube 30 may be operatively held in the selected position relative to the first elongate tube 20. The second elongate tube is co-axial to the first elongate tube. At least a portion of the exterior surface of each of the first and second elongate tubes 20, 30 is sized and shaped for receipt of a conventional golf grip.

The clamp assembly 40 has an exterior surface 41 and defines a bore 44 extending longitudinally from a proximal end 46 to a distal end 48 of the clamp assembly. Within the bore of the clamp assembly, a male protrusion 50 extends from a surface 51 of the bore towards the longitudinal axis of the clamp assembly. A lower portion 52 of the clamp assembly 40, proximate the distal end of the clamp assembly, is sized and shaped for complementary receipt within the top end 22 of the first tube so that the clamp assembly may be fixed relative to the first tube. In one embodiment, the exterior surface of the clamp assembly defines a shoulder surface 43 intermediate the proximal end and the distal end of the clamp assembly. In use, the lower portion of the clamp assembly, which in this embodiment is intermediate the shoulder surface 43 and the distal end 48 of the clamp assembly, is positioned within the interior of the first tube proximate the top end 22 of the first tube.

In one example, the lower portion 52 of the clamp assembly is sized and shaped to form a complementary interference fit with a selected portion of an inner surface of the first tube. Preferably, the lower portion 52 of the clamp assembly may extend within the first tube 20 less than three quarters of the length of the first tube, and more preferably less than or equal to half of the length of the first tube. Alternatively, the lower portion of the clamp assembly may preferably be between 1 and 20 inches in length, more preferably between 1 and 15 inches in length, and still more preferred, between 2 and 10 inches in length.

To facilitate ready removal and replacement of a conventional grip disposed on the first tube 20, the clamp assembly 40 may be formed from a clamp member 54 and an elongate tube member 55. The clamp member defines a longitudinally extending bore 57 and the tube member defines a longitudinally extending bore 56. One end of the elongate tube member 55 is shaped and sized for complementary receipt within one end of the clamp assembly 54. For example, the ends of the respective tube member and clamp assembly may have complementary threaded surfaces. When the elongate tube member is engaged to the clamp member, the bores 56, 57 of the clamp member and the tube member are co-axial and together form the bore 44 of the clamp assembly 40.

The clamp member 54 may define a screw aperture 58 and a set screw 59 may be provided that is sized and shaped for operative receipt within the screw aperture. In use, a portion of the set screw 59 may be positioned so that it contacts a portion of the tube member that is disposed within the end of the clamp member to aid in fixing the clamp member 54 relative to the tube member 55. In use, a portion of the tube member forms the lower portion of the clamp assembly, and when desired, such as to change the grip disposed onto the first tube, the clamp member 54 may be disengaged from the tube member 55 by backing off or removing the set screw, if used, and, in one example, by unscrewing the clamp member from the tube member. After a new grip is applied onto the first tube 20, the clamp member 54 may be reattached to the tube member 55 by reversing the dissembling procedure.

The clamp assembly further defines an orifice 60 extending from the surface 51 of the bore 44 toward the exterior surface 42 of the clamp assembly. The orifice 60 is preferably in an upper portion 53 of the clamp assembly, which, in one exemplified embodiment, is intermediate the shoulder surface and the proximal end of the clamp assembly. The orifice 60 preferably extends substantially transverse to the longitudinal axis of the clamp assembly and defines an annular shoulder surface 62 proximate the exterior surface of the clamp assembly. Further, an aperture 64 extends between the exterior surface of the clamp assembly and the annular shoulder surface 62. The aperture 64 has a smaller diameter than the orifice 60 and is in communication with the orifice.

The elongate shaft 70 has a forward end 72 and a spaced rear end 74 and is sized and shaped for complementary receipt within the bore 44 of the clamp assembly. The shaft 70 has a longitudinally extending slot 76 defined in a portion thereof that is sized and shaped for complementary engagement with the male protrusion 50 of the clamp assembly 40. In use, at least a portion of the shaft proximate its rear end is received within the bottom end 32 of the second tube 30 so that the shaft may be fixed relative to the second tube. In one example, a filler sleeve 78 may be positioned within the bottom end of the second tube. The filler sleeve has a bore 79 shaped and sized for receipt of that portion of the shaft received within the second tube. Further in use, a portion of the shaft 70 is positioned within the bore 44 of the clamp assembly and a portion of the shaft may be positioned within a portion of the interior of the first tube 20.

A captured fastening member 90 is also included. The captured fastening member is sized and shaped for operative receipt in the orifice 60 of the clamp assembly. In one example, the orifice 60 has a threaded surface and the captured fastening member 90 has a complementary threaded surface so the captured fastening member is movable relative to the orifice. The captured fastening member 90 is generally movable between a disengaged position and an engaged position. In the disengaged position, a drive end 92 of the fastening member 90 is moved toward the annular shoulder surface 62 of the orifice so that a contact end 94 is spaced from the exterior surface of the shaft 70, which is disposed within the bore 44 of the clamp assembly 40. In the engaged position, the drive end 92 of the fastening member is moved away from the annular shoulder surface 62 of the orifice so that a portion of the contact end 94 of the fastening member 90 is in contact with a portion of the exterior surface of the shaft 70. Thus, in the engaged position, the shaft 70 and the second tube 30 are releasably fixed relative to the clamp assembly 40.

In one example, the drive end 92 of the fastening member defines a socket 93. The socket 92 and the aperture 64 of the clamp assembly are substantially co-axial so that an operator may insert a tool through the aperture and into operative contact with the socket in order to move the fastening member 90.

Figure 4:
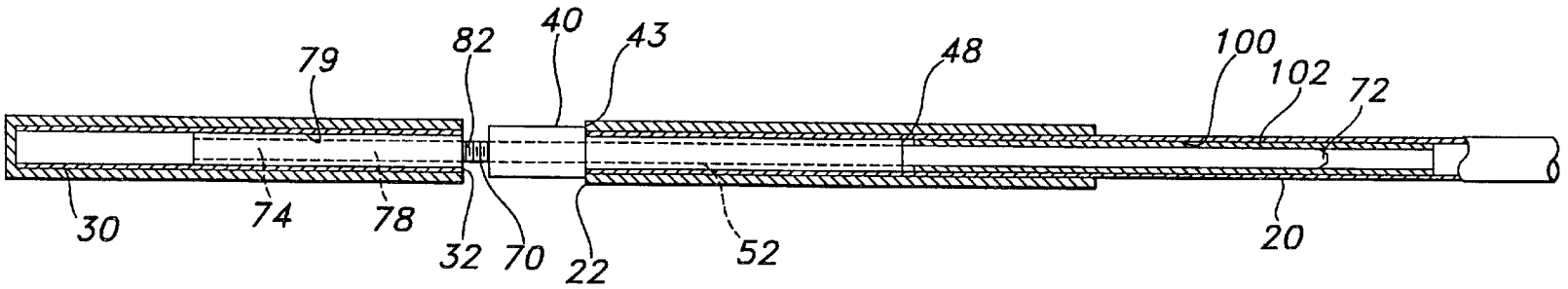
FIG. 4 is a partial cross-sectional view of an embodiment of the invention showing the clamp assembly connected to a first elongate tube and the shaft connected to a second elongate tube.

In one example, the shaft 70 of the invention may have a longitudinally extending row of female dimples 80 defined in the surface 71 of the shaft. This row of female dimples 80 may be positioned proximate the forward end 72 of the shaft. Further, the row of female dimples 80 is preferably positioned opposite the slot 76 defined in the surface of the shaft 70. Each of the dimples is preferably sized and shaped for complementary receipt of the contact end 94 of the captured fastening member therein. In addition, as shown in FIG. 4, intermediate the slot 76 and the row of female dimples 80 defined in the surface of the shaft, a longitudinally extending row of marks 82 may be defined on the surface 71 of the shaft 70. Preferably, each mark is spaced a predetermined distance from an adjoining mark.

To minimize vibration of a portion of the shaft 70 against a portion of the interior surface of the first tube 20 when the shaft is positioned therein the interior of the first tube 20, a hollow elongate non-metallic sleeve member 100 may be disposed within the interior of the first tube 20 intermediate the bottom end of the first tube and the distal end of the clamp assembly. In one example, a portion of the sleeve member 100 may contact a portion of the distal end 48 of the clamp assembly 40. The sleeve member defines a sleeve bore 102 that extends longitudinally therethrough and which is sized and shaped for receipt of at least a portion of the shaft 70. Thus, in use, when the forward end of the shaft extends beyond the distal end of the clamp assembly, at least a portion of the shaft may enter the sleeve bore to be surrounded thereby by a portion of the sleeve member 100 so that vibration is damped.

The invention has been described herein in detail, in order to comply with the Patent Statutes and to provide those skilled in the art with information needed to apply the novel principles, and to construct and use such specialized components as are required. However, it is to be understood, by those skilled in the art, that the invention can be carried out by specifically different equipment and devices, and that various modifications, both as to equipment details and operating procedures can be affected without departing from the scope of the invention itself. Further, it should be understood that, although the present invention has been described with reference to specific details of certain embodiments thereof, it is not intended that such details should be regarded as limitations upon the scope of the invention except as and to the extent that they are included in the accompanying claims.

What is claimed is:

1. A putter having an extendable shaft, comprising:

a) a putter head;

b) a first elongate tube having an open top end and a spaced bottom end, the bottom end of the first tube being connected to the putter head, c) a second elongate tube having an open bottom end, d) a clamp assembly having a longitudinal axis, a proximal end, a spaced distal end, and defining a bore extending longitudinally therethrough, the clamp assembly further having a male protrusion extending from a surface of the bore toward the longitudinal axis and an exterior surface extending between the proximal end and the distal end, the exterior surface defining a shoulder surface intermediate the proximal end and the distal end of the clamp assembly, a lower portion of the clamp assembly intermediate the shoulder surface and the distal end sized and shaped for complementary receipt within the top end of the first tube so that the clamp assembly is fixed relative to the first tube, wherein the clamp assembly further defines an orifice extending from the surface of the bore toward the exterior surface of the clamp assembly, the orifice having an annular shoulder surface proximate the exterior surface, the clamp assembly further defining an aperture extending between the exterior surface of the clamp assembly and the annular shoulder surface, e) an elongate shaft sized and shaped for complementary receipt within the bore of the clamp assembly, the shaft having a forward end and a spaced rear end, the shaft having a longitudinally extending slot defined in a portion thereof proximate the forward end of the shaft that is sized and shaped for complementary engagement with the male protrusion of the clamp assembly, at least a portion of the shaft proximate its rear end being received within the bottom end of the second tube so that the shaft is fixed relative to the second tube, and f) a captured fastening member having a drive end and an opposed contact end, the captured screw member being sized and shaped for operative receipt in the orifice of the clamp assembly and being movable between a disengaged position, in which the drive end of the fastening member is moved toward the annular shoulder surface of the orifice so that the contact end is spaced from the exterior surface of the shaft, and an engaged position, in which the drive end of the fastening member is moved away from the annular shoulder surface of the orifice so that a portion of the contact end is in contact with a portion of the exterior surface of the shaft such that the shaft and the second elongate tube are fixed relative to the clamp assembly.

2. The putter of claim 1, wherein the drive end of the fastening member defines a socket, and wherein the socket and the aperture of the clamp assembly are substantially co-axial.

3. The putter of claim 1, wherein the orifice extends substantially transverse to the longitudinal axis of the clamp assembly.

4. The putter of claim 1, wherein the shaft has a longitudinally extending row of female dimples defined in the surface of the shaft proximate the forward end thereof.

5. The putter of claim 4, wherein the row of female dimples on the surface of the shaft are positioned opposite the slot defined within the surface of the shaft.

6. The putter of claim 5, wherein the shaft has a longitudinally extending row of marks defined on the surface of the shaft intermediate the row of female dimples and the slot defined within the surface of the shaft, each mark is spaced a predetermined distance from the adjoining mark.

7. The putter of claim 4, wherein each said dimple is sized and shaped for complementary receipt of the contact head of the captured fastening member therein.

8. The putter of claim 1, further comprising a hollow elongate non-metallic sleeve member defining a sleeve bore extending longitudinally therethrough, the sleeve member disposed within the first tube intermediate the bottom end of the first tube and the distal end of the clamp assembly, the sleeve bore sized and shaped for receipt of at least a portion of the shaft.

9. The putter of claim 1, wherein the first tube has an inner surface, wherein the lower portion of the clamp assembly is sized and shaped to form a complementary interference fit with a selected portion of the inner surface of the first tube.

10. The putter of claim 1, wherein the lower portion of the clamp assembly extends within the first tube less than or equal to half of the length of the first tube.

11. The putter of claim 10, wherein the lower portion of the clamp assembly is between approximately 1 to approximately 15 inches in length.

12. The putter of claim 10, wherein the lower portion of the clamp assembly is between approximately 2 to approximately 10 inches in length.

13. The putter of claim 1, wherein the clamp assembly includes a clamp member and an elongate tube member, the clamp member defining a longitudinally extending bore, the tube member defining a longitudinally extending bore, one end of the elongate tube member being shaped and sized for complementary receipt within one end of the clamp member such that the bores of the clamp member and the tube member together form the bore of the clamp assembly.

14. The putter of claim 13, wherein the clamp assembly further includes a set screw, wherein the clamp member defines a screw aperture sized and shaped for operative receipt of the set screw such that, in use, a portion of the set screw is in contact a portion of the tube member disposed within the end of the clamp member so that the clamp member is fixed relative to the tube member.

15. An extendable shaft for a golf club, comprising a) a first elongate tube having an open top end, b) a second elongate tube having an open bottom end, c) a clamp assembly having a longitudinal axis, a proximal end, a spaced distal end, and defining a bore extending longitudinally therethrough, the clamp assembly further having a male protrusion extending from a surface of the bore toward the longitudinal axis and an exterior surface extending between the proximal end and the distal end, the exterior surface defining a shoulder surface intermediate the proximal end and the distal end of the clamp assembly, a lower portion of the clamp assembly intermediate the shoulder surface and the distal end sized and shaped for complementary receipt within the top end of the first tube so that the clamp assembly is fixed relative to the first tube, wherein the clamp assembly further defines an orifice extending from the surface of the bore toward the exterior surface of the clamp assembly, the orifice defining an annular shoulder surface proximate the exterior surface, the clamp assembly further defining an aperture extending between the exterior surface of the clamp assembly and the annular shoulder surface, d) an elongate shaft sized and shaped for complementary receipt within the bore of the clamp assembly, the shaft having a forward end and a spaced rear end, the shaft having a longitudinally extending slot defined in a portion thereof proximate the forward end of the shaft that is sized and shaped for complementary engagement with the male protrusion of the clamp assembly, at least a portion of the shaft proximate its rear end being received within the bottom end of the second tube so that the shaft is fixed relative to the second tube, and e) a captured fastening member having a drive end and an opposed contact end, the captured screw member being sized and shaped for operative receipt in the orifice of the clamp assembly and being movable between a disengaged position, in which the drive end of the fastening member is moved toward the annular shoulder surface of the orifice so that the contact end is spaced from the exterior surface of the shaft, and an engaged position, in which the drive end of the fastening member is moved away from the annular shoulder surface of the orifice so that a portion of the contact end is in contact with a portion of the exterior surface of the shaft such that the shaft and the second tube are fixed relative to the clamp assembly.

16. The extendable shaft of claim 15, wherein the drive end of the fastening member defines a socket, and wherein the socket and the aperture of the clamp assembly are substantially co-axial.

17. The extendable shaft of claim 15, wherein the orifice extends substantially transverse to the longitudinal axis of the clamp assembly.

18. The extendable shaft of claim 15, wherein the shaft has a longitudinally extending row of female dimples defined in the surface of the shaft proximate the forward end thereof.

19. The extendable shaft of claim 18, wherein the row of female dimples on the surface of the shaft are positioned opposite the slot defined within the surface of the shaft.

20. The extendable shaft of claim 19, wherein the shaft has a longitudinally extending row of marks defined on the surface of the shaft intermediate the row of female dimples and the slot defined within the surface of the shaft, each mark is spaced a predetermined distance from the adjoining mark.

21. The extendable shaft of claim 18, wherein each said dimple is sized and shaped for complementary receipt of the contact head of the captured fastening member therein.

22. The extendable shaft of claim 15, further comprising a hollow elongate nonmetallic sleeve member defining a sleeve bore extending longitudinally therethrough, the sleeve member disposed within the first tube intermediate the bottom end of the first tube and the distal end of the clamp assembly, the sleeve bore sized and shaped for receipt of at least a portion of the shaft.

23. The extendable shaft of claim 15, wherein the second tube has an inner surface, further comprising a second hollow elongate non-metallic sleeve member, the second sleeve member disposed intermediate at least a portion of the shaft proximate the rear end thereof and a portion of the inner surface of the second tube.

24. The extendable shaft of claim 15, wherein the first tube has an inner surface, wherein the lower portion of the clamp assembly is sized and shaped to form a complementary interference fit with a selected portion of the inner surface of the first tube.

25. The extendable shaft of claim 15, wherein the lower portion of the clamp assembly extends within the first tube less than or equal to half of the length of the first tube.

26. The extendable shaft of claim 25, wherein the lower portion of the clamp assembly is between approximately 1 to approximately 15 inches in length.

27. The extendable shaft of claim 25, wherein the lower portion of the clamp assembly is between approximately 2 to approximately 10 inches in length.

28. The extendable shaft of claim 15, wherein the clamp assembly includes a clamp member and an elongate tube member, the clamp member defining a longitudinally extending bore, the tube member defining a longitudinally extending bore, one end of the elongate tube member being shaped and sized for complementary receipt within one end of the clamp member such that the bores of the clamp member and the tube member together form the bore of the clamp assembly.

29. The extendable shaft of claim 28, wherein the clamp assembly further includes a set screw, wherein the clamp member defines a screw aperture sized and shaped for operative receipt of the set screw such that, in use, a portion of the set screw is in contact a portion of the tube member disposed within the end of the clamp member so that the clamp member is fixed relative to the tube member.

30. A putter having an extendable shaft, comprising:

a) a putter head;

b) a first elongate tube having an open top end and a spaced bottom end, the bottom end of the first tube being connected to the putter head, c) a second elongate tube having an open bottom end, d) a clamp assembly having a longitudinal axis and comprising a clamp member defining a first longitudinally extending bore and an elongate tube member defining a second longitudinally extending bore, one end of the elongate tube member being shaped and sized for complementary removable connection within one end of the clamp member such that the clamp member and the elongate tube member are fixed relative to each other and such that the first and second bores are coaxial and form a bore extending longitudinally therethrough the clamp assembly, the clamp assembly further having a proximal end, a spaced distal end, a male protrusion extending from a surface of the bore of the clamp assembly toward the longitudinal axis, and an exterior surface extending between the proximal end and the distal end, the exterior surface of the clamp assembly defining a shoulder surface at a juncture of the clamp member and the elongate tube member, at least a portion of the elongate tube member sized and shaped for complementary receipt within the top end of the first tube so that the clamp assembly is fixed relative to the first tube, wherein the clamp assembly further defines an orifice extending from the surface of the first bore toward the exterior surface of the clamp assembly, the orifice having an annular shoulder surface proximate the exterior surface, the clamp assembly further defining an aperture extending between the exterior surface of the clamp assembly and the annular shoulder surface, e) an elongate shaft sized and shaped for complementary receipt within the bore of the clamp assembly, the shaft having a forward end and a spaced rear end, the shaft having a longitudinally extending slot defined in a portion thereof proximate the forward end of the shaft that is sized and shaped for complementary engagement with the male protrusion of the clamp assembly, at least a portion of the shaft proximate its rear end being received within the bottom end of the second tube so that the shaft is fixed relative to the second tube, and f) a captured fastening member having a drive end and an opposed contact end, the captured screw member being sized and shaped for operative receipt in the orifice of the clamp assembly and being movable between a disengaged position, in which the drive end of the fastening member is moved toward the annular shoulder surface of the orifice so that the contact end is spaced from the exterior surface of the shaft, and an engaged position, in which the drive end of the fastening member is moved away from the annular shoulder surface of the orifice so that a portion of the contact end is in contact with a portion of the exterior surface of the shaft such that the shaft and the second elongate tube are fixed relative to the clamp assembly and the first elongate tube.

31. The putter of claim 30, wherein the clamp assembly further includes a set screw, wherein the clamp member defines a screw aperture sized and shaped for operative receipt of the set screw such that, in use, a portion of the set screw is in contact a portion of the tube member disposed within the end of the clamp member so that the clamp member is fixed relative to the tube member.

32. The putter of claim 30, wherein the shaft has a longitudinally extending row of female dimples defined in the surface of the shaft proximate the forward end thereof, each said dimple is sized and shaped for complementary receipt of the contact head of the captured fastening member therein.

33. The putter of claim 32, wherein the row of female dimples on the surface of the shaft are positioned opposite the slot defined within the surface of the shaft.

34. The putter of claim 33, wherein the shaft has a longitudinally extending row of marks defined on the surface of the shaft intermediate the row of female dimples and the slot defined within the surface of the shaft, each mark is spaced a predetermined distance from the adjoining mark.

35. The putter of claim 30, further comprising a hollow elongate non-metallic sleeve member defining a sleeve bore extending longitudinally therethrough, the sleeve member disposed within the first tube intermediate the bottom end of the first tube and the clamp assembly, the sleeve bore sized and shaped for receipt of at least a portion of the shaft.

36. An extendable shaft for a golf club, comprising:

a) a first elongate tube having an open top end, c) a second elongate tube having an open bottom end, d) a clamp assembly having a longitudinal axis and comprising a clamp member defining a first longitudinally extending bore and an elongate tube member defining a second longitudinally extending bore, one end of the elongate tube member being shaped and sized for complementary removable connection within one end of the clamp member such that the clamp member and the elongate tube member are fixed relative to each other and such that the first and second bores are coaxial and form a bore extending longitudinally therethrough the clamp assembly, the clamp assembly further having a proximal end, a spaced distal end, a male protrusion extending from a surface of the bore of the clamp assembly toward the longitudinal axis, and an exterior surface extending between the proximal end and the distal end, the exterior surface of the clamp assembly defining a shoulder surface at a juncture of the clamp member and the elongate tube member, at least a portion of the elongate tube member sized and shaped for complementary receipt within the top end of the first tube so that the clamp assembly is fixed relative to the first tube, wherein the clamp assembly further defines an orifice extending from the surface of the first bore toward the exterior surface of the clamp assembly, the orifice having an annular shoulder surface proximate the exterior surface, the clamp assembly further defining an aperture extending between the exterior surface of the clamp assembly and the annular shoulder surface, e) an elongate shaft sized and shaped for complementary receipt within the bore of the clamp assembly, the shaft having a forward end and a spaced rear end, the shaft having a longitudinally extending slot defined in a portion thereof proximate the forward end of the shaft that is sized and shaped for complementary engagement with the male protrusion of the clamp assembly, at least a portion of the shaft proximate its rear end being received within the bottom end of the second tube so that the shaft is fixed relative to the second tube, and f) a captured fastening member having a drive end and an opposed contact end, the captured screw member being sized and shaped for operative receipt in the orifice of the clamp assembly and being movable between a disengaged position, in which the drive end of the fastening member is moved toward the annular shoulder surface of the orifice so that the contact end is spaced from the exterior surface of the shaft, and an engaged position, in which the drive end of the fastening member is moved away from the annular shoulder surface of the orifice so that a portion of the contact end is in contact with a portion of the exterior surface of the shaft such that the shaft and the second elongate tube are fixed relative to the clamp assembly and the first elongate tube.

37. The extendible shaft of claim 36, wherein the clamp assembly further includes a set screw, wherein the clamp member defines a screw aperture sized and shaped for operative receipt of the set screw such that, in use, a portion of the set screw is in contact a portion of the tube member disposed within the end of the clamp member so that the clamp member is fixed relative to the tube member.

38. The putter of claim 36, wherein the shaft has a longitudinally extending row of female dimples defined in the surface of the shaft proximate the forward end thereof, each said dimple is sized and shaped for complementary receipt of the contact head of the captured fastening member therein.

39. The putter of claim 38, wherein the row of female dimples on the surface of the shaft are positioned opposite the slot defined within the surface of the shaft.

40. The putter of claim 39, wherein the shaft has a longitudinally extending row of marks defined on the surface of the shaft intermediate the row of female dimples and the slot defined within the surface of the shaft, each mark is spaced a predetermined distance from the adjoining mark.

41. The putter of claim 36, further comprising a hollow elongate non-metallic sleeve member defining a sleeve bore extending longitudinally therethrough, the sleeve member disposed within the first tube intermediate the bottom end of the first tube and the clamp assembly, the sleeve bore sized and shaped for receipt of at least a portion of the shaft.

42. A putter having an extendable shaft, comprising:

a) a putter head;

b) a first elongate tube having an open top end and a spaced bottom end, the bottom end of the first tube being connected to the putter head, c) a second elongate tube having an open bottom end, d) a clamp assembly having a longitudinal axis, a proximal end, a spaced distal end, and defining a bore extending longitudinally therethrough, the clamp assembly further having a male protrusion extending from a surface of the bore toward the longitudinal axis and an exterior surface extending between the proximal end and the distal end, a lower portion of the clamp assembly proximate the distal end sized and shaped for complementary receipt within the top end of the first tube so that the clamp assembly is fixed relative to the first tube, wherein the clamp assembly further defines an orifice extending from the surface of the bore toward the exterior surface of the clamp assembly, the orifice having an annular shoulder surface proximate the exterior surface, the clamp assembly further defining an aperture extending between the exterior surface of the clamp assembly and the annular shoulder surface, e) an elongate shaft sized and shaped for complementary receipt within the bore of the clamp assembly, the shaft having a forward end and a spaced rear end, the shaft having a longitudinally extending slot defined in a portion thereof proximate the forward end of the shaft that is sized and shaped for complementary engagement with the male protrusion of the clamp assembly, at least a portion of the shaft proximate its rear end being received within the bottom end of the second tube so that the shaft is fixed relative to the second tube, and f) a captured fastening member having a drive end and an opposed contact end, the captured screw member being sized and shaped for operative receipt in the orifice of the clamp assembly and being movable between a disengaged position, in which the drive end of the fastening member is moved toward the annular shoulder surface of the orifice so that the contact end is spaced from the exterior surface of the shaft, and an engaged position, in which the drive end of the fastening member is moved away from the annular shoulder surface of the orifice so that a portion of the contact end is in contact with a portion of the exterior surface of the shaft such that the shaft and the second elongate tube are fixed relative to the clamp assembly.

43. An extendable shaft for a golf club, comprising a) a first elongate tube having an open top end, b) a second elongate tube having an open bottom end, c) a clamp assembly having a longitudinal axis, a proximal end, a spaced distal end, and defining a bore extending longitudinally therethrough, the clamp assembly further having a male protrusion extending from a surface of the bore toward the longitudinal axis and an exterior surface extending between the proximal end and the distal end, a lower portion of the clamp assembly proximate the distal end sized and shaped for complementary receipt within the top end of the first tube so that the clamp assembly is fixed relative to the first tube, wherein the clamp assembly further defines an orifice extending from the surface of the bore toward the exterior surface of the clamp assembly, the orifice defining an annular shoulder surface proximate the exterior surface, the clamp assembly further defining an aperture extending between the exterior surface of the clamp assembly and the annular shoulder surface, d) an elongate shaft sized and shaped for complementary receipt within the bore of the clamp assembly, the shaft having a forward end and a spaced rear end, the shaft having a longitudinally extending slot defined in a portion thereof proximate the forward end of the shaft that is sized and shaped for complementary engagement with the male protrusion of the clamp assembly, at least a portion of the shaft proximate its rear end being received within the bottom end of the second tube so that the shaft is fixed relative to the second tube, and e) a captured fastening member having a drive end and an opposed contact end, the captured screw member being sized and shaped for operative receipt in the orifice of the clamp assembly and being movable between a disengaged position, in which the drive end of the fastening member is moved toward the annular shoulder surface of the orifice so that the contact end is spaced from the exterior surface of the shaft, and an engaged position, in which the drive end of the fastening member is moved away from the annular shoulder surface of the orifice so that a portion of the contact end is in contact with a portion of the exterior surface of the shaft such that the shaft and the second tube are fixed relative to the clamp assembly.

* * * * *